US005570533A

United States Patent [19]

Vouyouka

[11] Patent Number: 5,570,533

[45] Date of Patent: Nov. 5, 1996

[54] INDUSTRIAL PATTERN GRADING TEMPLATE

[76] Inventor: Anastasia Vouyouka, Amorgou Street 8, 54638 Thessaloniki, Greece

[21] Appl. No.: 404,937

[22] Filed: Mar. 14, 1995

Related U.S. Application Data

[63] Continuation of Ser. No. 15,803, Feb. 10, 1993, abandoned.

[30] Foreign Application Priority Data

Feb. 13, 1993 [GR] Greece ..... 920100055

[51] Int. Cl.[6] ..... A41H 3/00

[52] U.S. Cl. ..... 33/17 A; 33/12

[58] Field of Search ..... 33/12, 16, 17 A, 33/5, 562, 563, 565

[56] References Cited

U.S. PATENT DOCUMENTS

| | | | |
|---|---|---|---|
| 155,322 | 9/1874 | Lemley | 33/12 |
| 182,968 | 10/1876 | Steinor et al. | 33/12 |
| 185,842 | 1/1877 | Subera | 33/12 |
| 811,770 | 2/1906 | Freeman | 33/12 |
| 1,616,080 | 2/1927 | Freedman | 33/12 |
| 2,689,402 | 9/1954 | Breitbart | 33/17 A |
| 2,711,588 | 6/1955 | Ingram | 33/12 |
| 2,885,784 | 5/1959 | Fox | 33/17 A |
| 3,367,029 | 2/1968 | Lee | 33/17 A |
| 3,745,656 | 7/1973 | Sweeney | 33/14 |
| 3,833,158 | 9/1974 | Cavrich | 223/68 |
| 3,842,430 | 10/1974 | Hudspeth | 354/187 |
| 3,877,047 | 4/1975 | Douglas | 354/158 |
| 4,019,257 | 4/1977 | Cavrich | 33/17 |
| 4,156,969 | 6/1979 | Werber | 33/14 |
| 4,205,446 | 6/1980 | Gibson | 33/17 A |
| 4,242,800 | 1/1981 | Werber | 33/14 |
| 4,324,046 | 4/1982 | Weinberg | 33/17 A |
| 4,565,006 | 1/1986 | Vouyouka | 33/11 |
| 4,642,896 | 2/1987 | Grimm | 33/17 |
| 4,675,253 | 6/1987 | Bowditch | 428/542.8 |
| 4,916,624 | 4/1990 | Collins et al. | 364/917.3 |
| 4,916,634 | 4/1990 | Collins et al. | 364/513 |
| 4,926,344 | 5/1990 | Collins et al. | 364/513 |
| 5,150,478 | 9/1992 | Niedajkasza et al. | 2/243 |

FOREIGN PATENT DOCUMENTS

| | | | |
|---|---|---|---|
| 7594 | 5/1933 | Australia | 33/12 |
| 379461 | 11/1907 | France | 33/12 |
| 939838 | 11/1948 | France | 33/12 |
| 255942 | 2/1949 | Sweden | 33/12 |
| 399676 | 10/1933 | United Kingdom | 33/12 |
| 955868 | 4/1964 | United Kingdom | 33/17 A |

*Primary Examiner*—Thomas B. Will
*Attorney, Agent, or Firm*—Alfred Walker

[57] ABSTRACT

The present invention relates to an industrial pattern grading template and a method for using such a template for the upgrading or downgrading of all types and parts of a garment concurrently in all the internationally standardized sizes. Both the template and the method for using it are appropriate for vocational technical training and professional use in the mass production of garments. With the present invention, starting from a single initial size, the concurrent construction of all the required size variations of the different parts of a garment is achieved, with simplicity, certainty and absolute precision, in minimal time without geometry and complex calculations. The template has two sides and a plurality of elongate apertures of variable length and direction. These apertures are adjusted to the basic points of a garment pattern block, and they have appropriate subdivisions and scales of proportionate grading for the grading of every part of a garment.

4 Claims, 3 Drawing Sheets

INDUSTRIAL PATTERN GRADING TEMPLATE

This application is a continuation of application Ser. No. 08/015,803, filed Feb. 10, 1993 now abandoned.

FIELD OF THE INVENTION

The present invention relates to an industrial pattern grading template and a method for using such a template. The present invention is particularly useful in grading all types and parts of a garment, concurrently in all the internationally standardized sizes. The template is appropriate for use in vocational technical training together with professional use in the mass production of garments.

SUMMARY OF THE INVENTION

The present invention provides a template for the grading of sizes of all types and parts of a garment, according to the international standardization of sizes, the template being rectangular, of appropriate proportions and made of an appropriate material, having two sides and a plurality of elongate apertures of variable length and direction, accompanied by metric subdivisions and scales of proportionate grading, together with other auxiliary designs which indicate the position of the grading points on a basic pattern block. The template of the present invention allows the grading of any garment pattern block, which includes thereon all of the required variations according to the internationally standardized sizes and may be utilized for grading each of the different parts of a garment, with simplicity, certainty and absolute precision, in minimal time without geometry and complex calculations.

The apertures with their appropriate subdivisions and grading scales are placed touching the basic points of any garment pattern block and the indication of their position is shown in projection on each of the auxiliary designs, A, B, C, D, E, F, and G.

A: Being the quarter front upper basic block

B: Being the basic sleeve block

C: Being the quarter back upper basic block

D: Being the quarter front skirt

E: Being the quarter front trouser block

F: Being the quarter back skirt

G: Being the quarter back trouser block.

Scales X represent dart and notch grading points and features Z are designs of parts of a garment serving as an indication of where the grading of these blocks is effected.

DESCRIPTION OF THE DRAWINGS

The present invention will now be described in relation to the accompanying drawings which illustrate a preferred embodiment of the present invention and the use of that preferred embodiment.

IN THE DRAWINGS

Figure 1:
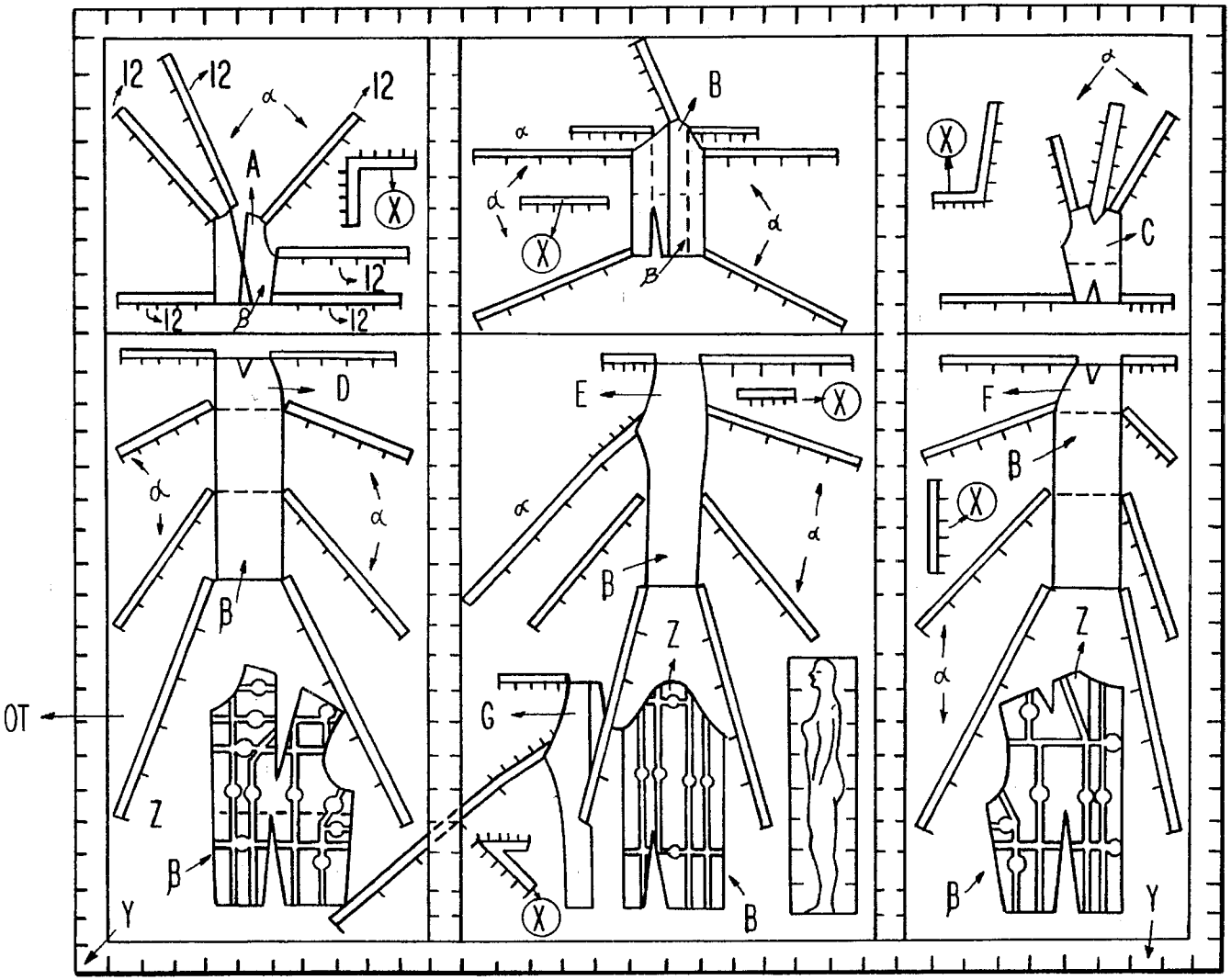
Figure 2C:
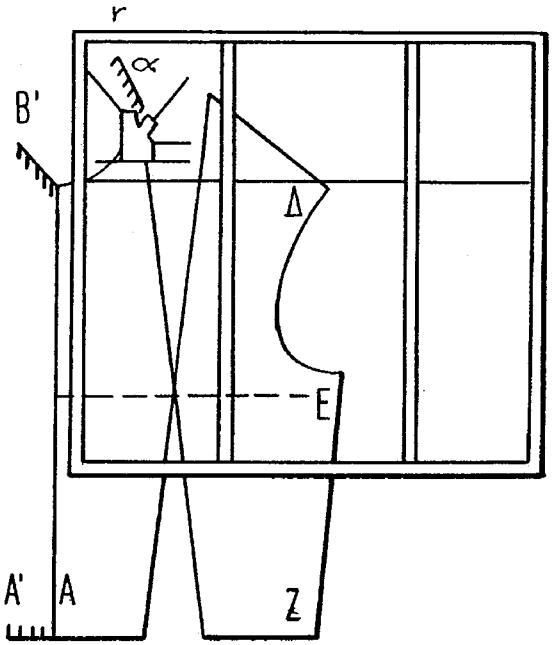
Figure 2B:
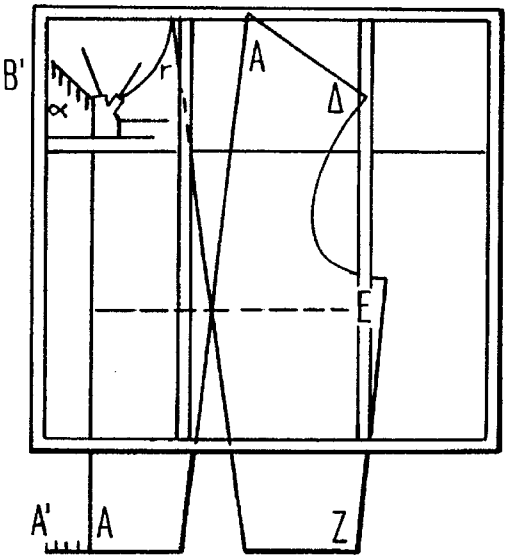
Figure 2A:
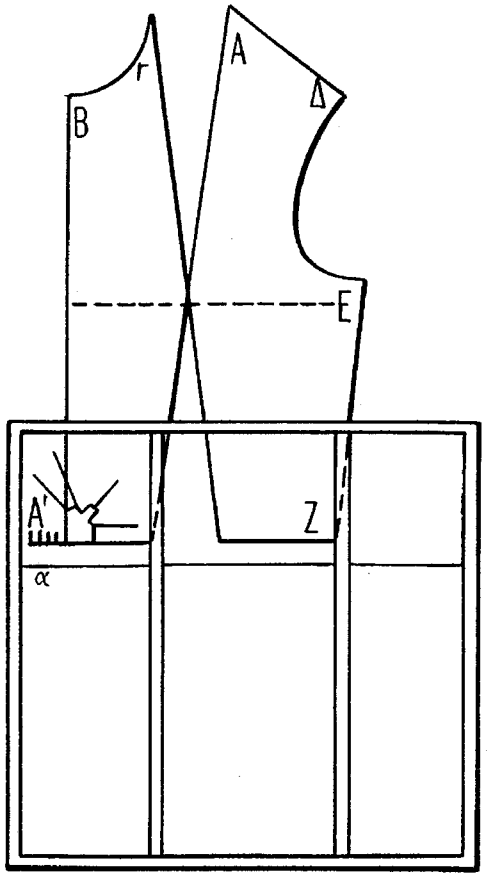
Figure 2E:
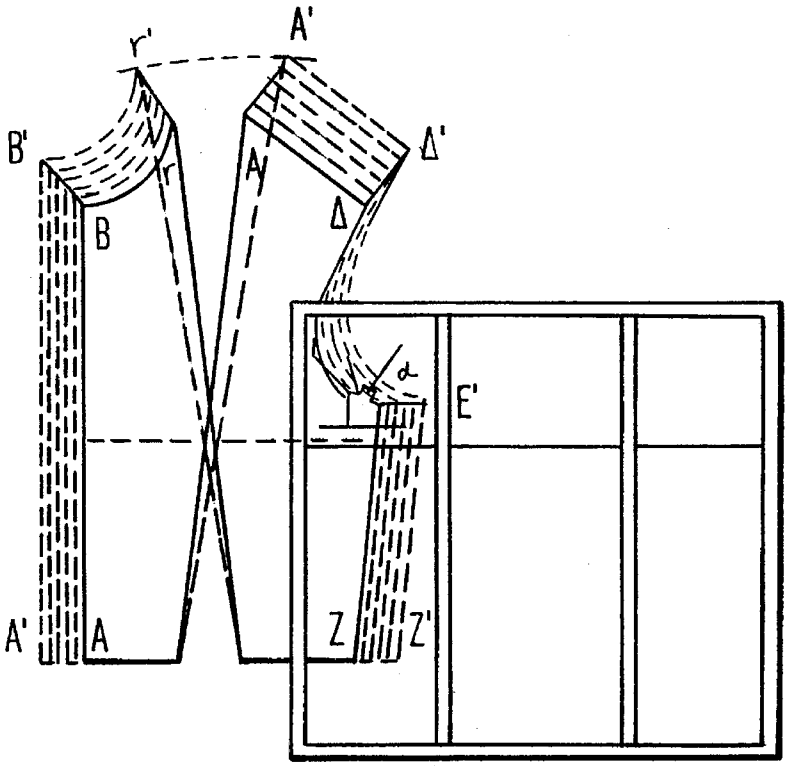
Figure 2D:
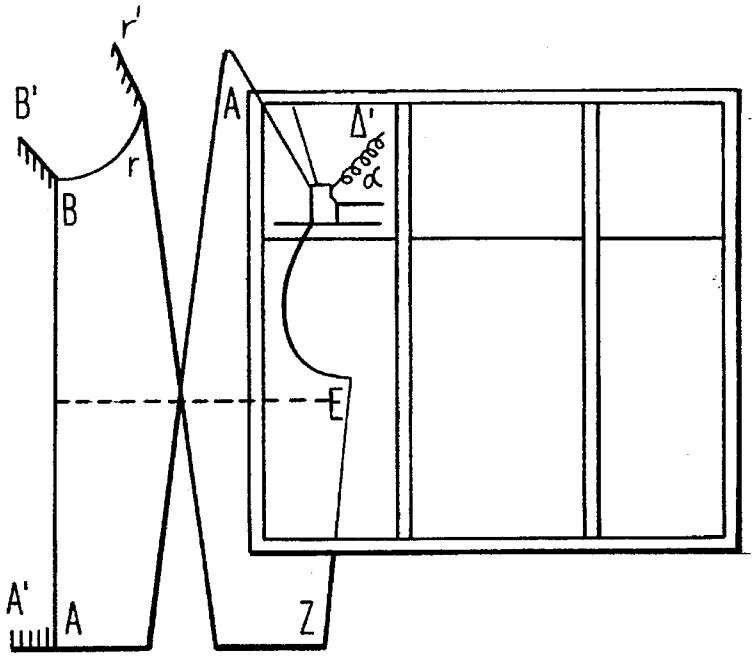

FIG. 1 is a plan view of a preferred embodiment of template in accordance with the present invention;

FIG. 2*a* is a plan view showing the template as in FIG. 1 in use with a garment pattern block;

FIG. 2*b* is a plan view showing the template as in FIG. 1 in a further step in use with a garment pattern block;

FIG. 2*c* is a plan view showing the template as in FIG. 1 in still another step in use with a garment pattern block;

FIG. 2*d* is a plan view showing the template as in FIG. 1 in yet another further step in use with a garment pattern block; and, FIG. 2*e* is a plan view showing the template as in FIG. 1 in a final step in use with a garment pattern block.

DETAILED DESCRIPTION OF THE DRAWINGS

FIG. 1 illustrates a template 10 having a series of depictions of various parts of a pattern indicated as A, B, C, D, E, F, G. At various locations about those depictions are a plurality of apertures 12 (only given reference numerals in relation to depiction A) that include appropriate subdivisions and grading scales for the various international sizes. These apertures are located adjacent to the basic grading points of the depictions of the various parts of the garment.

Also provided are various metric subdivisions 14 about the periphery of each of the various sections of the template 10 necessary for the adjustment and right angle placement of the template to the basic existing axes of the coordinates of the pattern block.

Referring to the five stages of use of the template 10 as illustrated in FIG. 2, FIG. 2*a* shows the first stage of use. Prior to this stage, the pattern block of the basic initial size (for example, European size 46) which one wants to grade (for example, front female bodice) is drawn on a sheet of paper, leaving ample space around it so that all the required graded sizes may be included thereon. The template is placed over the pattern block such that the point from which the first grading is to commence (for example, the waist point on the Center Front (C.F.) of the bodice as illustrated in FIG. 2*a*) coincides with and touches the same point on the depiction A on the template 10. The template is set at a right angle to the basic axis of coordinates of the block and the corresponding aperture is used to mark on the block the line and the subdivisions given by the template.

The template is then moved to the next point of grading on the initial pattern block (for example, the neck curve as illustrated in FIG. 2*b*) and again a right angle is formed with the axis of the coordinates of the basic pattern block. The line and it subdivisions are then marked through the corresponding aperture.

The process is continued for the next point of grading on the initial pattern block (namely the neck point on the shoulder as illustrated in FIG. 2*c*) and the template is placed so that this point touches the aperture corresponding to the same point on the template and a right angle is formed as before. The line is the marked and the subdivisions are as given by the aperture.

The same procedure is followed for the remaining points of grading as they appear on a model of the front bodice on the template (and as shown in FIGS. 2*d* and 2*e* placing the corresponding apertures on the initial block and marking through them the lines and their subdivisions.

Finally, the corresponding points of the subdivisions are joined together with straight lines and curves parallel to each other and to those of the initial block, and there are then formed six blocks in total of proportionate sizes.

Furthermore, and in a similar way, sizes may be downgraded beginning from a block of a large initial size and placing the template so that the largest subdivision to every aperture touches the corresponding point on the initial block.

It will be appreciated that there may be other modifications and alterations to the configurations described herein that are also within the scope of the present invention.

I claim:

1. A template having a horizontal X axis and a vertical Y axis for the three-dimensional grading of pattern blocks having corresponding X and Y axes, of all parts of a garment, from one size to another size according to the international standardization of sizes, said template being rectangular, said template having a front and back side, said template having a plurality of models of various basic garment pattern blocks which together form the parts of the garment, each of said models being a miniature representation of an individual pattern block, each of said models including a plurality of elongated apertures of variable length and direction, said apertures including indicia corresponding to standardized increments of grading from size to size and positioned with respect to the X and Y axes of the garment, said template including at least one set of metric subdivision indicia for the adjustment and placement of the template X and Y axes and the corresponding X and Y axes of a pattern block being graded, said template including at least one auxiliary design portion, said auxiliary design portion indicating positions of a plurality of grading points on a basic pattern block.

2. A template, according to claim 1, further comprising a plurality of further auxiliary design portions indicating positions of a plurality of grading points for other basic pattern blocks, and a plurality of further metric subdivision indicia for assisting with the adjustment and placement of said template on a pattern block being graded.

3. A method of constructing graded patterns utilizing said template as in claim 1, said method including the steps of drawing on a sheet of paper a block of a basic initial size to be upgraded or downgraded to a desired predetermined size, placing said template upon said sheet of paper so that a point from which said upgrading or said downgrading begins touches an identical point on said block, placing said template in a corresponding position with the X and Y axes of said template and said pattern block aligned and marking in a corresponding aperture of said template a given line and a plurality of given subdivisions, repeating the previous steps for a plurality of points either to upgrade or downgrade said basic initial size, and joining said printed points on said sheet of paper and depicting said graded points of said pattern block in said predetermined size.

4. A method of constructing graded patterns utilizing said template as in claim said method including the steps of drawing on a sheet of paper a block of a basic initial size to be upgraded or downgraded to a desired predetermined size, placing said template upon said sheet of paper so that a point from which said upgrading or said downgrading begins touches identical points on said block, placing said template in a corresponding position with the X and Y axes of said template and said pattern block aligned and marking in a corresponding aperture of said template a given line and a plurality of given subdivisions, repeating the previous steps for a plurality of points either to upgrade or downgrade said basic initial size, and joining said printed points on said sheet of paper and depicting said graded points of said pattern block in said predetermined size.

* * * * *